US006283028B1

(12) United States Patent
Walczak

(10) Patent No.: US 6,283,028 B1
(45) **Date of Patent: *Sep. 4, 2001**

(54) OFFLINE TUBULAR BLANKET WASHING SYSTEM

(75) Inventor: Peter Walter Walczak, Dover, NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/237,695

(22) Filed: Jan. 26, 1999

(51) Int. Cl.[7] ..... B41F 35/00
(52) U.S. Cl. ..... 101/425; 101/424
(58) Field of Search ..... 101/425, 423, 101/424, 483; 15/256.53, 256.54, 256.51, 256.5, 179, 181–183, 151, 230, 230.16, 230.18; 134/153

(56) References Cited

U.S. PATENT DOCUMENTS

| | | | | |
|---|---|---|---|---|
| 2,597,946 | * | 5/1952 | Olson | 34/95 |
| 3,438,078 | * | 4/1969 | Muselaers | 101/425 |
| 4,108,683 | * | 8/1978 | Anderson | 134/27 |
| 4,215,928 | * | 8/1980 | Bayley et al. | 134/153 |
| 5,253,006 | * | 10/1993 | Bayley et al. | 354/317 |
| 5,277,111 | * | 1/1994 | Uribe et al. | 101/425 |
| 5,365,556 | * | 11/1994 | Mallie | 376/272 |
| 5,392,953 | * | 2/1995 | Maldabus et al. | 211/97 |
| 5,813,336 | | 9/1998 | Guaraldi et al. | 101/218 |
| 5,884,751 | * | 3/1999 | Metivier | 15/256.53 |
| 5,925,231 | * | 7/1999 | Metzger | 205/127 |

FOREIGN PATENT DOCUMENTS

| | | | | |
|---|---|---|---|---|
| 2040811 | * | 9/1980 | (GB) | 101/425 |

* cited by examiner

*Primary Examiner*—John S. Hilten
*Assistant Examiner*—Anthony H. Nguyen
(74) *Attorney, Agent, or Firm*—Herbert L. Lerner; Laurence A. Greenberg; Werner H. Stemer

(57) ABSTRACT

An offline tubular blanket washing system includes a tube washer for cleaning blanket tubes removed from a printing unit. A storage rack receives the blanket tubes cleaned in the tube washer and stores the blanket tubes for installation in the printing unit.

9 Claims, 2 Drawing Sheets

Fig.1
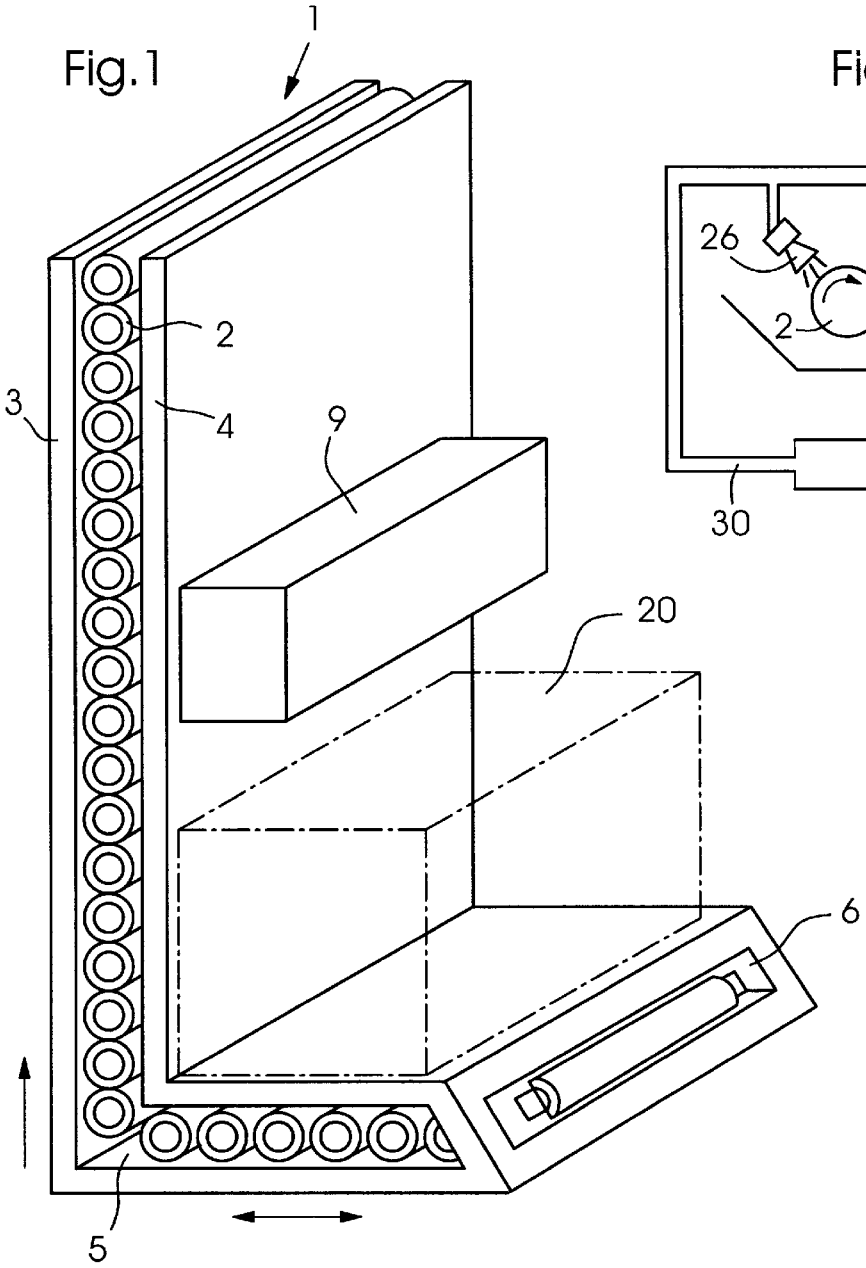
Fig.5
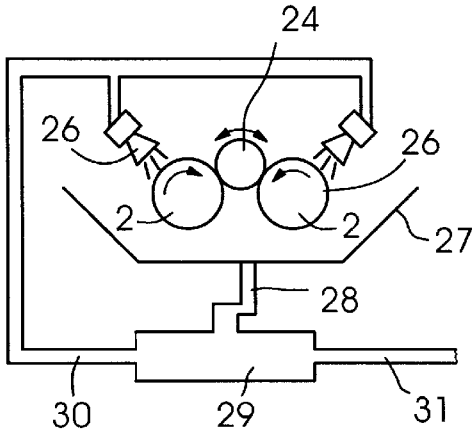
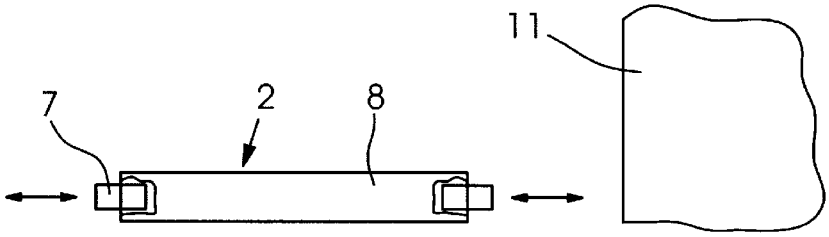
Fig.3

OFFLINE TUBULAR BLANKET WASHING SYSTEM

BACKGROUND OF THE INVENTION

Field of the Invention

The invention relates to a tubular blanket washing system which is offline, i.e. not part of a printing press.

Offset lithographic web printing presses have printing units containing several printing cylinders rotating between side frames. The cylinders include a print cylinder carrying a print form having an image thereon and a blanket cylinder carrying a blanket tube. The image is transferred from the print form to the blanket tube and from the blanket tube to the web.

Vertical and horizontal web offset presses having gapless blanket tubes may include on-press blanket washers. Such washers are typically integrated into the structure of the press. However, end users of web offset presses often do not purchase on-press blanket washers and therefore manual washing of the blanket tubes must be performed. This results in down-time for the press and accordingly must be performed quickly leaving little time for inspection. The tubes do not have time to "rest" and be rejuvenated and the use of chemicals on the press is required.

In addition, some presses have limited access for washing the blanket tubes and some washing chemicals are not recommended for use on the press. In such cases, the blanket tubes must be removed for cleaning. U.S. Pat. No. 5,813,336 discloses a printing unit from which print forms and blanket tubes can be removed through an opening in a side frame.

SUMMARY OF THE INVENTION

It is accordingly an object of the invention to provide an offline tubular blanket washing system, which overcomes the herein afore-mentioned disadvantages of the heretofore-known devices of this general type, which reduces down-time while permitting the surface of the blanket tube to be cleaned quickly and inspected for quality and performance, which is less labor-intensive, permits the tubes to rest and be rejuvenated between production runs, controls the use of chemicals and efficiently stores unused blanket tubes.

With the foregoing and other objects in view there is provided, in accordance with the invention, an offline tubular blanket washing system, comprising a tube washer for cleaning blanket tubes removed from a printing unit; and a storage rack for receiving the blanket tubes cleaned in the tube washer and storing the blanket tubes for installation in the printing unit. The tube washer may be disposed on the storage rack.

Through the use of this device, two sets of blanket tubes can be used, one on and one off the press. The tubes are washed by the tube washing off the press instead of by personnel manning the press. Compounds and conditioners for rejuvenating the surface of the blanket tube my be employed. Cleaned blanket tubes are always ready in the storage rack to be installed in the printing units.

In accordance with another feature of the invention, the tube washer includes side frames for rotatably supporting one or two blanket tubes, a driven rotating brush rotatably supported in the side frames for cleaning the blanket tubes, and one or two cleaning solution applicators associated with the blanket tubes and the rotating brush.

In accordance with a further feature of the invention, the tube washer includes a waste collector disposed below the blanket tubes and the rotating brush for receiving the cleaning solution. The tube washer may also have a filter and treatment device for receiving the cleaning solution and selectively guiding the cleaning solution back to the cleaning solution applicators.

In accordance with an added feature of the invention, the blanket tubes are installed in and removed from the tube washer through one of the side frames.

In accordance with an additional feature of the invention, the storage rack has two side walls defining a slot therebetween for receiving the blanket tubes from the tube washer and dispensing the blanket tubes for installation in the printing unit.

In accordance with yet another feature of the invention, according to one embodiment, the slot is L-shaped, and the storage rack has a blanket tube pick up and return region associated with the slot. According to another embodiment, the slot is inverted U-shaped, and the storage rack has a blanket tube pickup region and a blanket tube return region associated with the slot. The storage rack may also be horizontally oriented.

In accordance with a concomitant feature of the invention, the storage rack has an environmental control device for the blanket tubes.

Other features which are considered as characteristic for the invention are set forth in the appended claims.

Although the invention is illustrated and described herein as embodied in an offline tubular blanket washing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic, perspective view of a two-directional blanket tube storage and conditioning system with a blanket tube washer shown in phantom;

FIG. 3 is a partly broken-away, front-elevational view of a blanket tube with storage chucks and a fragmentary, side-elevational view of a printing unit using the blanket tube;

FIG. 5 is a side-elevational view of the blanket tube washer with side frames removed.

DESCRIPTION OF THE PREFERRED EMBODIMENTS

Figure 2:
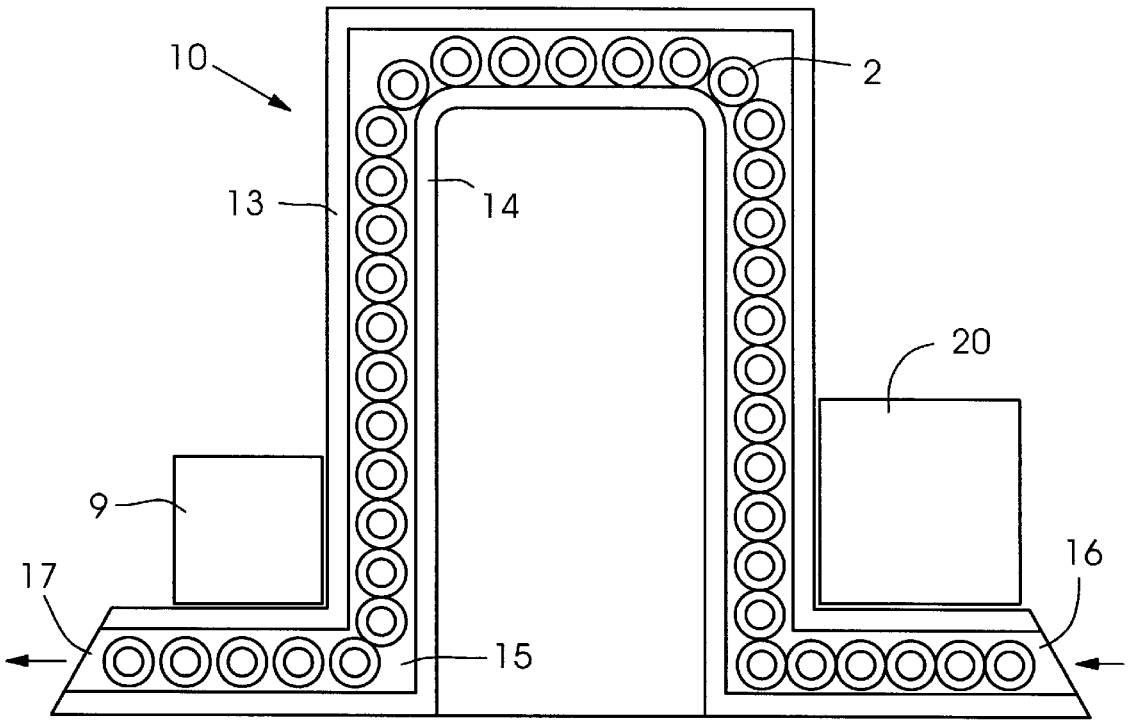
FIG. 2 is a side-elevational view of a one-directional blanket tube storage and conditioning system with a blanket tube washer shown in outline form.

Referring now to the figures of the drawings in detail and first, particularly, to FIG. 1 thereof, there is seen a two-directional blanket tube storage and conditioning system having a storage rack 1 for blanket tubes 2. The storage rack 1 may be installed at the location of a printing press. The storage rack 1 has L-shaped walls 3, 4 defining a slot 5 through which the blanket tubes 2 can move. The slot 5 has a blanket tube pick up and return region 6. A blanket tube washer 20 is shown in phantom in FIG. 1 to illustrate its position on the storage rack 1, but will be described in greater detail below with regard to FIG. 4. The blanket tubes 2 may be inserted into the slot 5 through the region 6 after washing and conditioning and may be removed through the region 6 for installation in a printing unit 11 shown in FIG. 2. An environmental control device 9, which is installed on the wall 4, may be an air conditioning system blowing into the slot 5 for rejuvenating the blanket tubes 2 after cleaning in the blanket tube washer 20.

FIG. 2 shows a one-directional blanket tube storage and conditioning system having a storage rack 10 for the blanket tubes 2. The storage rack 10 is intended to be installed at a location other than at a printing press. The storage rack 10 has Ω-shaped or inverted U-shaped walls 13, 14 defining a slot 15 for the blanket tubes 2. The slot has a clean blanket tube pickup region 16 and a clean blanket tube return region 17. The blanket tube washer 20 is shown in outline form on the storage rack 10. The environmental control device 9 is also installed on the storage rack 10.

FIG. 3 is a front-elevational view of a blanket tube 2 removed from the printing unit 11. The blanket tube 2 has storage chucks 7 and a gapless blanket 8.

Figure 4:
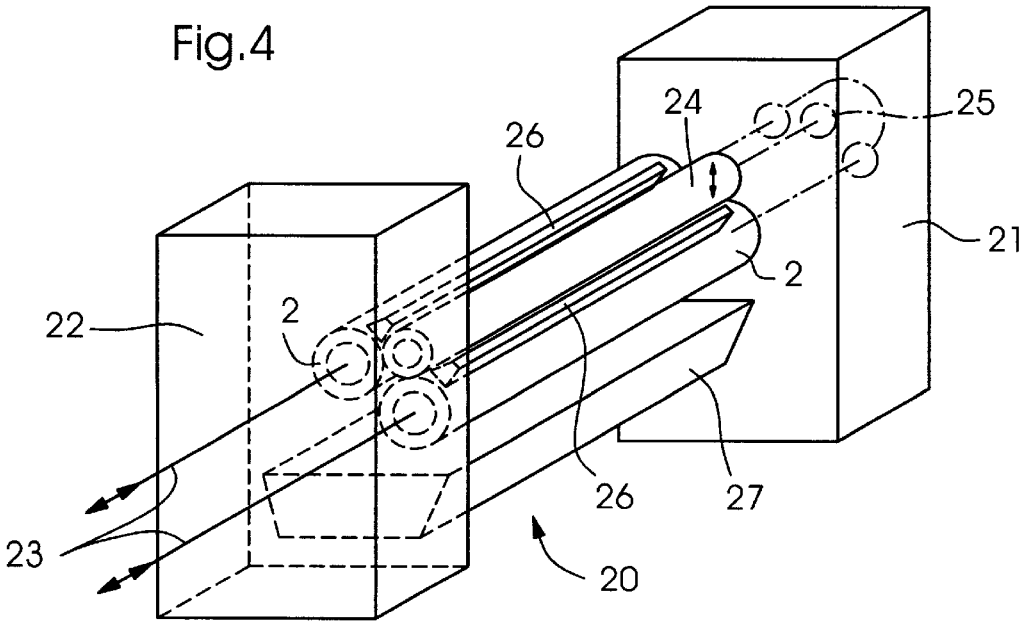
FIG. 4 is an enlarged, perspective view of the blanket tube washer.

FIG. 4 shows details of the tube washer 20. The tube washer 20 has a drive-side frame 21 containing AC or pneumatic motors 25 and an operator-side frame 22. Two blanket tubes 2 are journaled between the side frames 21, 22 and are driven by two of the motors 25 so as to rotate on the chucks 7. The blanket tubes 2 to be cleaned and conditioned are installed in and removed from the tube washer 20 in the direction of arrows 23 through the side frame 22. The installation and removal is accomplished as described in U.S. Pat. No. 5,813,336. A rotating brush 24 is also journaled between the side frames 21, 22 and is driven by one of the motors 25. Naturally, one motor may be used with appropriate gearing, instead of three. The brush 24 may be moved vertically as indicated by a doubled-headed arrow, into and out of contact with the blanket tubes 2. Two cleaning solution applicators 26 are each disposed above a respective one of the blanket tubes 2. Finally, a waste collector 27 is disposed between the side frames 21, 22 and below the blanket tubes 2 and rotating brush 24 for collecting cleaning solution dropping from the blanket tubes.

FIG. 5 shows the cleaning solution applicators 26, the blanket tubes 2 and the rotating brush 24 installed in the tube washer 20 above the waste collector 27. As is illustrated by arrows in FIG. 5, the brush 24 reciprocates in circumferential direction and the blanket tubes 2 rotate toward each other. The cleaning solution is applied by the applicators 26 so as to clean and recondition the blanket tubes 2. Waste solution dropping into the collector 27 is removed through a tube 28 leading to a filter and treatment device 29 for the waste solution. The treated solution may be returned to the applicators 26 through a tube 30 or removed through a tube 31 for further treatment.

The actual cleaning sequence takes place by rotating the blanket tubes 2 and then applying the washing fluid or cleaning solution. The brush 24 is then placed in contact with the blanket tubes and rotated against them. After a period of time, the rotation is stopped and the blanket tubes are removed from the tube washer 20.

According to the invention, blanket tubes 2 are removed from a printing unit 11 and cleaned and conditioned in a tube washer 20 installed on a storage rack 1 or 10 according to FIG. 1 or FIG. 2. The cleaned and conditioned tubes are placed into a pick up and return region 6 or a pickup region 16 of the storage rack 1 or 10. The cleaned and conditioned tubes are then removed from the storage rack through the pick up and return region 6 or the return region 17 and placed into the printing unit 11 as needed. The storage rack may be located alongside the press of offsite. It is also noted that the storage rack may be horizontally configured, with the walls 3, 4 in a horizontal orientation and the region 6 facing upward.

I claim:

1. An offline tubular blanket washing system for cleaning blanket tubes, comprising:

a tube washer, the tube washer including side frames and a brush, the brush being rotably supported between the side frames, the tube washer receiving at least one blanket tube, the at least one blanket tube being mounted on storage chucks and being rotably supported between the side frames, the tube washer cleaning the at least one blanket tube removed from a printing unit; and a storage rack, the storage rack having two side walls defining a slot therebetween, the blanket tubes being inserted into the slot through a pickup region, the storage rack receiving the blanket tubes cleaned in the tube washer and storing the blanket tubes for installation in the printing unit.

2. The blanket washing system according to claim 1, wherein said tube washer includes at least one cleaning solution applicator associated with the at least one blanket tube and said rotating brush.

3. The blanket washing system according to claim 2, wherein said at least one cleaning solution applicator is two cleaning solution applicators.

4. The blanket washing system according to claim 3, wherein said tube washer includes a waste collector disposed below the blanket tubes and said rotating brush for receiving the cleaning solution.

5. The blanket washing system according to claim 4, wherein said tube washer includes a filter and treatment device for receiving the cleaning solution.

6. The blanket washing system according to claim 3, wherein the blanket tubes are installed in and removed from said tube washer through one of said side frames.

7. The blanket washing system according to claim 1, wherein said slot is L-shaped, and said storage rack has a blanket tube pick up and return region associated with said slot.

8. The blanket washing system according to claim 1, wherein said slot is inverted U-shaped, and said storage rack has a blanket tube pickup region and a blanket tube return region associated with said slot.

9. The blanket washing system according to claim 1, wherein said storage rack has an environmental control device for the blanket tubes.

* * * * *